United States Patent [19]

Beethem et al.

[11] 4,412,484

[45] Nov. 1, 1983

[54] STRAPPING MACHINE

[75] Inventors: William J. Beethem, Cheboygan; Lynn D. Rumsey, Flint, both of Mich.

[73] Assignee: General Motors Corporation, Detroit, Mich.

[21] Appl. No.: 408,633

[22] Filed: Aug. 16, 1982

[51] Int. Cl.[3] ..... B65B 13/04

[52] U.S. Cl. ..... 100/7; 100/4; 100/26

[58] Field of Search ..... 100/4, 7, 26

[56] References Cited

U.S. PATENT DOCUMENTS

| | | | |
|---|---|---|---|
| 3,213,780 | 10/1965 | Neitzel | 100/4 |
| 3,220,337 | 11/1965 | Goland | 100/7 |
| 3,377,944 | 4/1968 | Hill | 100/7 |
| 3,521,550 | 7/1970 | Van Doorn | 100/26 |
| 3,720,158 | 3/1973 | Sauer | 100/4 |
| 3,733,769 | 5/1973 | Van Doorn | 100/26 X |
| 4,150,615 | 4/1979 | Russell | 100/7 |

*Primary Examiner*—Billy J. Wilhite

*Attorney, Agent, or Firm*—Edward J. Biskup

[57] ABSTRACT

A strapping machine having a pair of strap-feeder and tensioning devices and a pair of vertically movable chutes which cooperate with the strap-feeder and tensioning devices for applying straps to a package at spaced points thereof and are adjustable horizontally together with the strap-feeder and tensioning devices for varying the distance between the straps.

5 Claims, 3 Drawing Figures

STRAPPING MACHINE

This invention concerns a strapping machine and more particularly relates to a machine which simultaneously applies a plurality of straps at spaced points of a package for maintaining the package intact during storage and shipment.

More specifically the present invention pertains to a strapping machine that incorporates a pair of spaced strap-feeder and tensioning devices and a pair of chutes which cooperate with the aforesaid devices for winding and tensioning a pair of straps about a package. Each of the chutes is normally separated from its associated strap-feeder and tensioning device and is supported for movement between a raised or open position and a lowered or closed position. When each of the chutes is in the raised position, the package is fed into the machine and is positioned so that it spans the spaced strap-feeder and tensioning devices. The chutes are then moved to the lower position after which the strap-feeder and tensioning devices are activated to cause a pair of straps to be guided by the chutes around the package followed by a tensioning and welding of each of the straps.

The strapping machine according to the present invention is also characterized in that the distance between the strap-feeder and tensioning devices can be varied so that the straps can be applied to areas of the package where they are the most effective in maintaining the package whole. This feature of the present invention is realized by supporting each of the chutes and the associated strap-feeder and tensioning device for adjustable movement along a horizontal axis. In the preferred form, the adjustable horizontal movement of each of the chutes and each associated strap-feeder and tensioning device is achieved through a pair of parallel guide rods and a screw and nut arrangement driven by an electric stepper motor so that coordinated movement of the chute and associated strap-feeder and tensioning device is assured.

Another feature of the strapping machine according to the present invention is that pivotally interconnected subframe members are provided that serve to support both of the strap-feeder and tensioning devices and the associated chutes for adjustable positioning about a transverse horizontal axis. This permits the straps to follow paths lying in converging planes during the strapping operation. Thus, a V-shaped package (such as provided when a V-shaped automobile bumper bar is wrapped) can have the straps simultaneously applied thereto at right angles to each of the leg portions of the package.

Accordingly, the objects of the present invention are to provide a new and improved strapping machine incorporating a strap-feeder and tensioning device that is combined with a vertically movable chute which is initially raised relative to the strap-feeder and tensioning device for receiving the package and afterwards lowered for performing the strapping operation; to provide a new and improved strapping machine having a pair of strap-feeder and tensioning devices and a pair of vertically movable chutes operatively associated therewith all of which are adjustable horizontally so that the distance between the pair of straps to be applied to a package can be varied; and to provide a new and improved strapping machine that includes a pair of strap-feeder and tensioning devices combined with a pair of chutes and characterized in that each strap-feeder and tensioning device and associated chute is supported on a subframe that is tiltable about a horizontal axis so as to allow each leg of a V-shaped package to have a strap applied thereto at right angles relative to the leg.

Other objects and advantages of the present invention will be apparent from the following detailed description when taken with the drawings in which.

Figure 1:
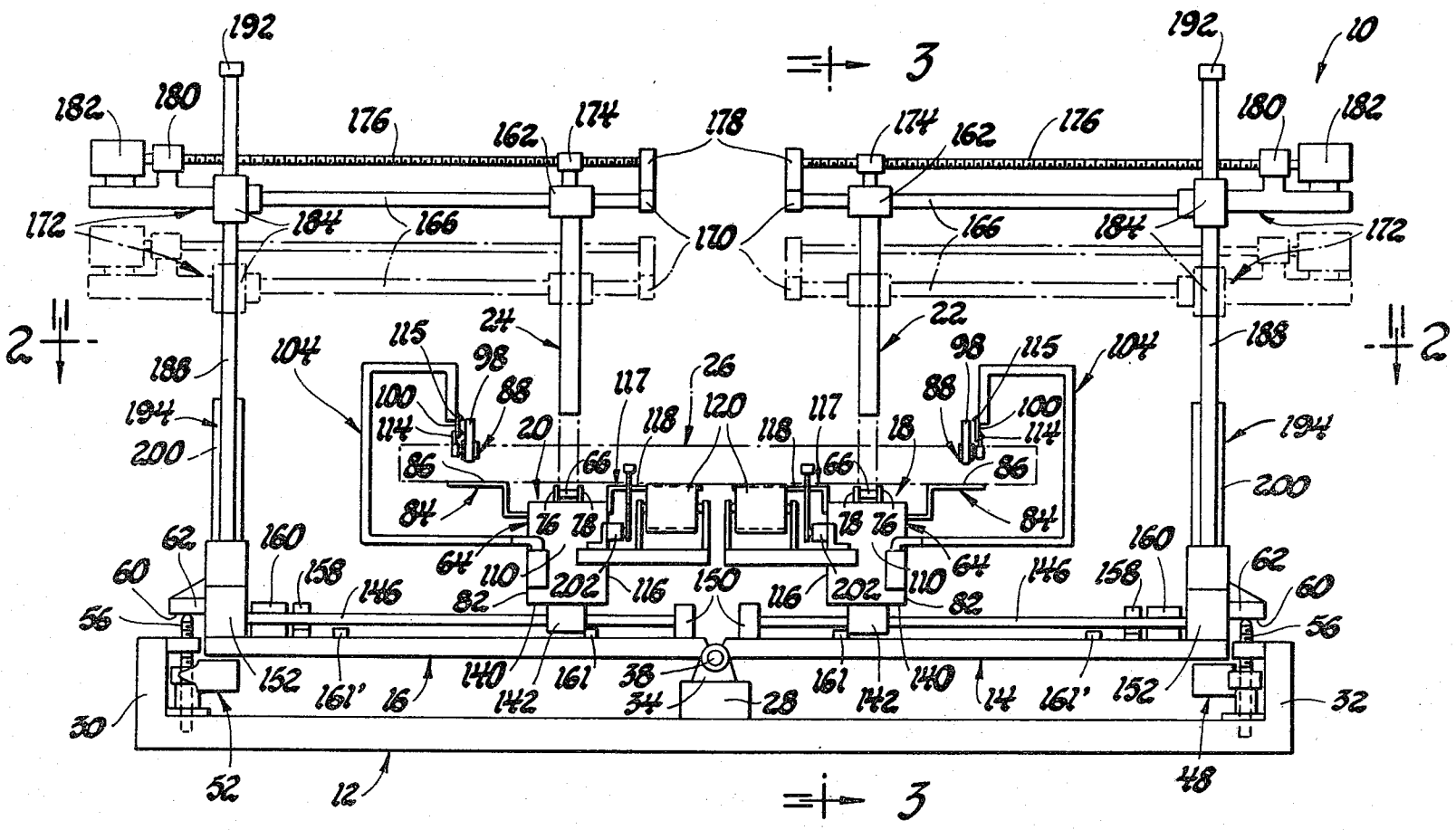
FIG. 1 is a front elevational view of a strapping machine supporting a pair of strap-feeder and tensioning devices and a pair of chutes in accordance with the present invention.

Referring now to the drawings and more particularly to FIG. 1 thereof a strapping machine 10 made in accordance with the present invention is shown comprising, in general, a base frame member 12 and a pair of subframe members 14 and 16 which, respectively, support a pair of strap-feeder and tensioning devices 18 and 20 and a pair of chutes 22 and 24. As will be described more fully hereinafter each chute 22, 24 is adapted to cooperate with the associated strap-feeder and tensioning device 18, 20 for applying a strap around a package such as the package shown in phantom lines and indicated by the reference numeral 26.

Figure 2:
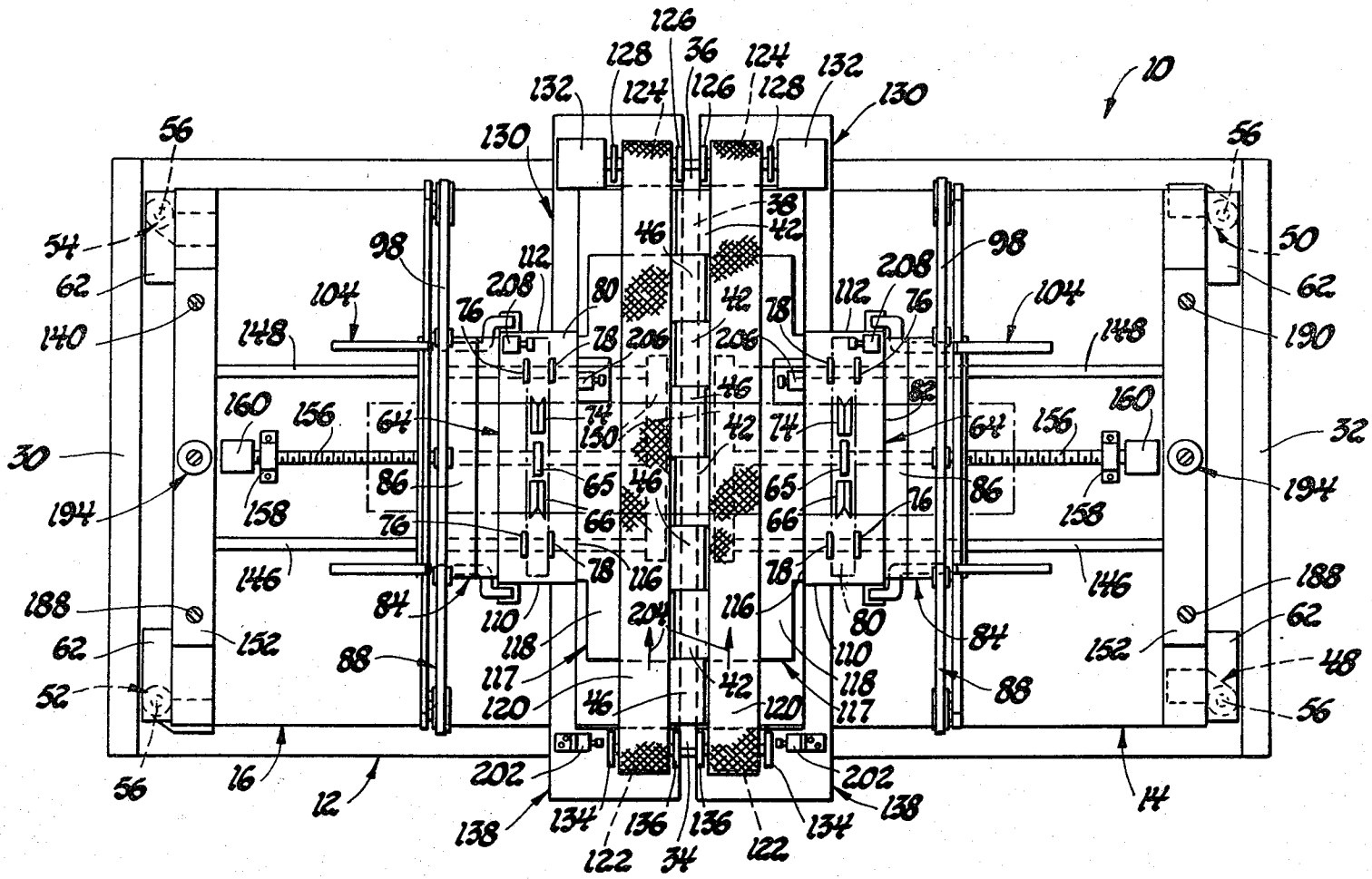
FIG. 2 is a plan view of the strapping machine taken on line 2—2 of FIG. 1.

The base frame member 12 is formed with a central support portion 28 and a pair of longitudinally spaced end support portions 30 and 32. As seen in FIGS. 1 and 2, a pair of laterally spaced bearing members 34 and 36 are rigidly secured to the central support portion 28 and serve to support the opposite ends of a pivot shaft 38 which extends transversely relative to the longitudinal axis of the base frame member 12. The subframe member 14 is connected to the pivot shaft 38 at its inner end by four laterally spaced barrel members 42 while the corresponding inner end of the subframe member 16 is connected to the pivot shaft 38 by four laterally spaced barrel members 46. Thus, the subframe members 14 and 16 are supported for pivotal movement about the longitudinal center axis of pivot shaft 38 and, in this regard, it will be noted that subframe member 14 is adjustably movable about pivot shaft 38 under the control of a pair of screwjack devices 48 and 50 connected to the end support portion 32 of the base frame member 12 while subframe member 16 is adjustably movable about the pivot shaft 38 by a pair of identical screwjack devices 52 and 54 connected to the end support portion 30. As is conventional, each screwjack device 50–54 includes a screw shaft 56 combined with a worm gear (not shown) which upon rotation causes vertical movement of the associated screw shaft 56. The upper end of each screw shaft 56 contacts the flat underside 60 of a ledge 62 rigidly connected to the associated subframe member. Although not shown, a suitable shafting arrangement interconnects the worm gears of all of the screwjack devices 50–54 so that one reversible electric motor serves to provide simultaneous drive to all of the screwjack devices 50–54 to thereby cause simultaneous vertical movement of the screw shafts 56 either in a downward or upward direction.

The strap-feeder and tensioning devices 18 and 20 respectively supported by the subframe members 14 and 16 are identical in construction but mirror images of each other, and each strap feeder and tensioning devices 18, 20 includes the usual operating mechanism, not shown, located within a rectangular box-like housing 64. The operating mechanism in each housing 64 serves to feed a strap made of polyester or other plastic material through a feedhead 65 and feed guide member 66 into a strap entry portion 68 of the chute and then along a generally circular track 70 (FIG. 3) formed in the associated chute when the chute is in the lower position shown in phantom lines in FIGS. 1 and 3. After the strap makes a complete circuit about the track 70, the strap leaves the chute via a strap exit portion 72 and the leading end of the strap travels through a funnel shape guide member 74 into the operating mechanism hitting a stop within the housing 64. The operating mechanism continues to feed more strap into the chute causing the excess strap to fold up into a chamber resulting in a drop arm to swing open. This trips a limit switch signalling the motor driving the operating mechanism to reverse. The same signal actuates a solenoid-operated gripper which grips the free end of the strap. The operating mechanism then tensions the strap about the package and as soon as a preset tension is reached, a clutch shifts over to engage a welding cycle gear train. As soon as the welding cycle is completed, the strap is cut.

A strap-feeder and tensioning device and chute of the type used with the present invention, is substantially identical to the Automatic Power Strapping Machine Model 500-EE, manufactured by Signode Corporation, Chicago, Ill. 60647. The only difference in the strap-feeder and tensioning devices 18 and 20 and associated chutes 22 and 24 employed with the strapping machine 10 is that neither chute 22, 24 is permanently attached to the associated strap-feeder and tensioning device as is the case with the Signode Model 500-EE. Also, after completing the welding cycle and cutting the strap, the Signode Model 500-EE causes the motor of its operating mechanism to reverse direction shift clutch and feed the strap into the chute until it is approximately $\frac{3}{4}$ full. On the other hand, in the case of each of the strap-feeder and tensioning devices 18, 20, the controls of the operating mechanism employed therewith have been modified so that after the strap is cut, it remains in the freehead 65 or in the strap feed guide member 66 and does not enter the strap entry portion 68 of the chute.

Figure 3:
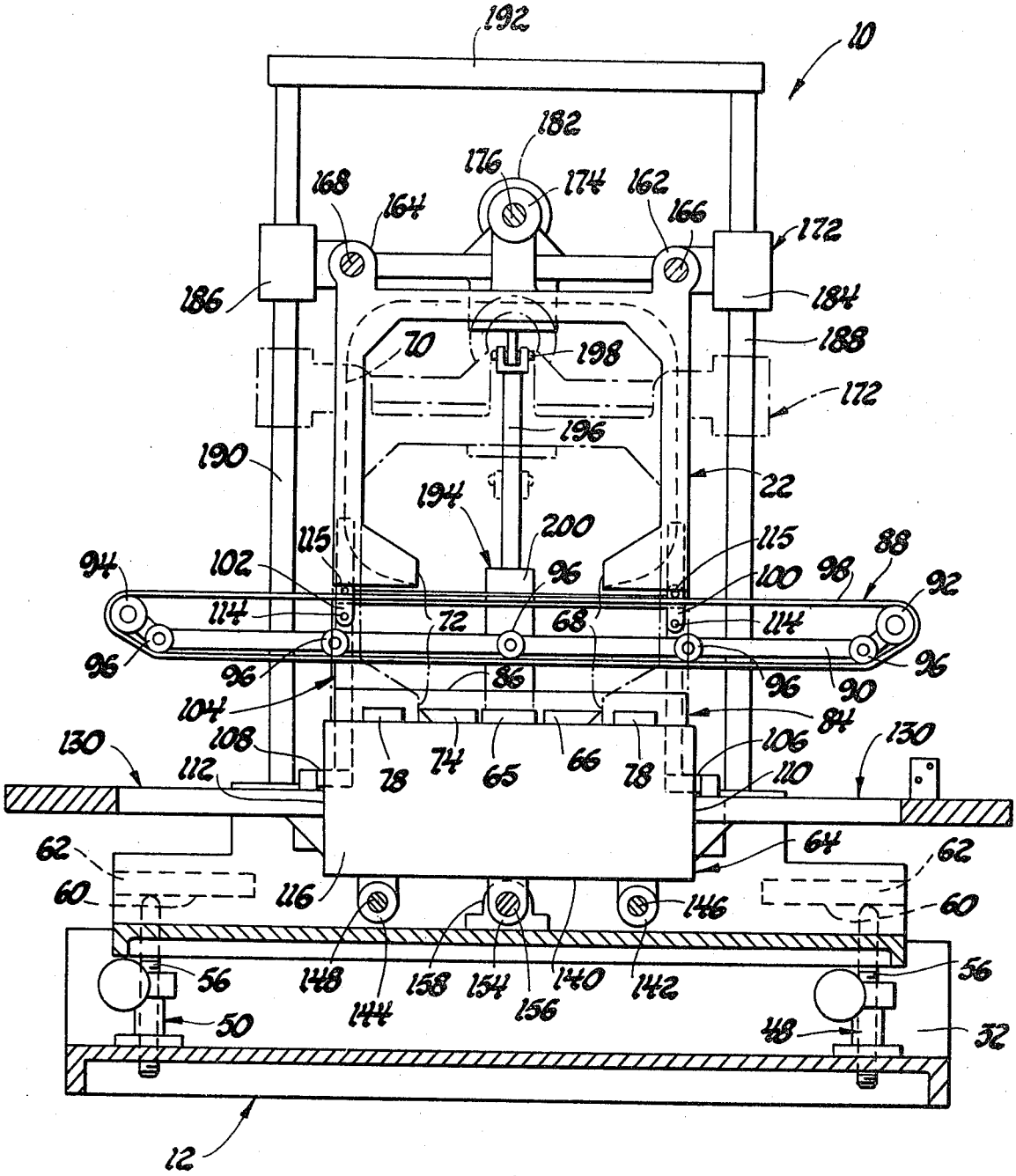
FIG. 3 is an enlarged side view taken on line 3—3 of FIG. 1 and shows the supporting structure for one of the strap-feeder and tensioning devices and the associated chute.

As seen in FIGS. 2 and 3, each strap-feeder and tensioning device 18, 20 has the strap feedhead 65 axially aligned with the feed guide member 66 and the strap return guide member 74. Also, upstanding locater members 76 and 78 are affixed to the top portion 80 of the housing 64 in axial alignment with and adjacent to the feed guide member 66 and the strap return guide member 74. The locater members 76 and 78 serve to properly position the associated chute when it is moved into the lower position.

One side wall 82 of the housing 64 of each strap-feeder and tensioning device 18 and 20 supports a sheet metal table 84 having a flat upper surface 86. Located above the flat surface 86 of the table 84 is a hold-down device 88 which, as seen in FIG. 3, includes an elongated wheel frame 90 having a pair of large diameter wheels 92 and 94 rotatably mounted at the opposite ends of the wheel frame 90. A plurality of identical small diameter wheels 96 are equally spaced along the length of the wheel frame 90 and a narrow width belt 98 is entrained about the large diameter wheels 92 and 94 and the small diameter wheels 96. The hold-down device 88 is supported through a pair of links 100 and 102 by a tubular frame 104, the lower ends 106 and 108 of which are respectively connected to the front and rear walls 110 and 112 of the housing 64. Each link 100, 102 is connected at its opposite ends by pivotal connections 114 and 115 to the tubular frame 104 and the wheel frame 90 of the hold-down device 88.

The other side wall 116 of the housing 64 of each strap-feeder and tensioning device 18 and 20 also supports a table 117 having a flat upper surface 118 which, in this case, serves as a base for an endless conveyor belt 120 entrained about an idler roller 122 and a driven roller 124. The driven roller 124 is rotatably supported between a pair of bearing members 126 and 128 mounted on an L-shaped arm 130 (as viewed in FIG. 2) secured to the rear wall 112 of the housing 64. An electric motor 132, mounted on the arm 130, is drivingly connected to the driven roller 124. Similarly, the idler wheel 122 is rotatably supported between a pair of bearing members 134 and 136 mounted on an L-shaped arm 138 (as viewed in FIG. 2) secured to the front wall 110 of the housing 64. As seen in FIG. 1, the tables 84 and 116 connected to the housing 64 of each strap-feeder and tensioning device 18 and 20 are located in a common plane which is perpendicular to the plane of the associated chute.

As seen in FIGS. 1 and 3, the base 140 of the housing 64 of each strap-feeder and tensioning device 18 and 20 is rigidly formed with a pair of laterally spaced linear bearing members 142 and 144 which are respectively mounted on parallel and cylindrical guide rods 146 and 148. The inner ends of the guide rods 146 and 148 are supported by a block member 150 rigidly connected to the inner end of the associated subframe member adjacent the pivot shaft 38. The outer ends of the guide rods 146 and 148 are supported by an upstanding support portion 152 of the outer end of the associated subframe member. Located between the guide rods 146 and 148 and threadably engaged with a nut 154 which is rigid with the base 140 of each housing 64 is an elongated threaded rod 156, the longitudinal center axis of which is parallel to the center axis of each of the guide rods 146 and 148. The inner end of each threaded rod 156 is rotatably supported by a suitable bearing, not shown, carried by the block member 150 while the outer end of each threaded rod 156 is rotatably supported by a bearing block 158 secured to the associated subframe member. A reversible electric stepper motor 160 is drivingly connected to the outer end of the threaded rod 156. Thus, by energizing the stepper motor 160, the threaded rod is rotated in one direction or the other causing the housing 64 to be moved along the guide rods 146 and 148 toward or away from the pivot shaft 38 as limited by the stop members 161 and 161′ fixed to the associated subframe member.

Each of the chutes 22 and 24 is identical in construction and, as seen in FIG. 3, the chute 22 is generally C-shaped formed with the track 70 which guides the strap around the package and, as aforedescribed, the strap entry portion 68 and the strap exit portion 72 are adapted to register with the strap feed guide member 66 and the strap return guide member 74, respectively, when the chute is in the lowered position.

As in the case with the housing 64 of each of the strap-feeder and tensioning devices 18 and 20, each of the chutes 22 and 24 is formed with laterally spaced linear bearing members 162 and 164 which are adjustably movable along a pair of parallel and cylindrical guide rods 166 and 168, respectively, the inner ends of which are supported by a cross bar 170. The outer ends of the guide rods 166 and 168 are rigidly connected to a carriage 172 which is supported for adjustable vertical movement. The longitudinal center axis of each of the guide rods 166 and 168 is parallel to the longitudinal center axis of each of the guide rods 146 and 148 which support the associated strap-feeder and tensioning device. Also, as with the associated strap-feeder and tensioning device, each chute 22 and 24 rigidly supports a nut 174 which is threadably engaged by an elongated threaded rod 176, the inner end of which is rotatably received by a bearing block 178 fixed to the cross bar 170. The outer end of the threaded rod 176 is rotatably mounted in a bearing block 180 secured to the carriage 172. A reversible electric stepper motor 182 is drivingly connected to the outer end of the threaded rod 176, the thread pitch of which is the same as the thread pitch of threaded rod 156.

As mentioned above, the carriage 172 is supported for adjustable vertical movement and, in this regard, it will be noted that the carriage 172 is formed with linear bearing members 184 and 186 mounted, respectively, on parallel and cylindrical guide rods 188 and 190. The lower ends of the guide rods 188 and 190 are supported by the associated subframe member while the upper ends of the guide rods 188 and 190 are interconnected by a cross bar 192. The longitudinal center axes of the guide rods 188 and 190 are located in a plane which is perpendicular to a plane passing through the longitudinal center axes of the guide rods 146 and 148 supported by the same subframe member.

Movement of the carriage 172 and, accordingly, the associated chute between the full line raised position and the phantom line lowered position as seen in FIGS. 1 and 3, is realized through a double acting air cylinder 194. As seen in FIG. 3, the piston rod 196 of the air cylinder 194 is connected to the carriage 172 by a pivotal connection 198 while the cylinder portion 200 of the air cylinder 194 is connected to the support portion 152 of the associated subframe member by a pivotal connection, not shown.

The operation of the strapping machine 10 described above is as follows: Assuming the package to have straps applied thereto is a straight elongated package such as shown in phantom lines and identified by reference numeral 26 in FIGS. 1 and 2, the package is first centered relative to the pivot shaft 38 and placed on the spaced belts 120 with the longitudinal axis of the package parallel to the longitudinal axes of the guide rods 146 and 148. The package is then manually moved towards the chutes 22 and 24 causing a limit switch 202 adjacent each belt 120 to be closed. As the package is moved towards the chutes 22 and 24, the top part of the package will be engaged by the belt 98 of each of the hold-down devices 88. This causes each hold-down device 88 to pivot upwardly under the control of the links 100 and 102 while maintaining the belt 98 in contact with the top part of the package. When both limit switches 202 are closed, the electric motor 132 associated with each belt 120 is energized causing the belts 120 to move in the direction of the arrows 204 to carry the package 26 toward the center of the machine 10. During movement of the package towards the center of the machine 10 the weight of the hold-down device 88 causes the belt 98 to be pressed against the package resulting in the belt 98 moving about the wheels 92, 94 and 96 while maintaining contact with the top part of the package. When the package reaches the center of the machine 10, the package contacts and closes limit switch 206 attached to side wall 116 of housing 64 of each strap-feeder and tensioning devices 18 and 20. When both limit switches 206 are closed both electric motors 132 are deenergized stopping movement of the belts 120. At this point the package is in the "home" position. The closing of limit switches 206 by the package (in addition to deenergizing the electric motors 132) also provides a signal which causes each air cylinder 194 to be actuated so as to move both carriages 172 and, accordingly, both chutes 22 and 24 from the raised open position to the lowered closed position. When each chute 22,24, is lowered it moves into the locater members 76 and 78 which position the strap entry portion 68 and the strap exit portion 72 accurately relative to the strap feed guide member 66 and the strap return guide member 74. When each chute 22 and 24 is properly lowered and positioned relative to the associated strap-feeder and tensioning device, a limit switch 208 adjacent the rear wall 112 of the housing 64 is closed by the chute to provide a signal which allows the operating mechanism contained in the housing 64 to be activated. This causes a pair of straps to be applied to the package as explained herein before, after which a signal is provided by the operating mechanism upon completion of the strapping cycle so as to cause actuation of each of the air cylinders 194 to raise the chutes 22 and 24 from the lowered closed position to the raised open position. Placing another package on the front ends of the belts 120 and moving it towards the chutes so as to trip the limit switches 204 permits the operating cycle described above to be repeated while causing the package already strapped to be conveyed to the rear end of the belts 120 wherefrom the strapped package moves into an accumulator conveyor (not shown).

If for some reason, it is desired that the pair of straps be applied further apart, the stepper motors 160 and 182 on each of the subframe members 14 and 16 are simultaneously energized. Inasmuch as the pitch of the threads on the threaded rods 156 and 176 is the same, energization of the stepper motors 160 and 182 results in coordinated and synchronous movement away from the pivot shaft 38 of each strap-feeder and tensioning device and its associated chute on each subframe member until stop member 161' is contacted by linear bearing 142. As should be apparent, energization of the stepper motors 160 and 182 on one of the subframe members only, would cause coordinated synchronous movement of only the strap-feeder and tensioning device and associated chute on that particular subframe.

Finally it will be noted that the subframe members 14 and 16 can be pivotally adjusted about the pivot shaft 38 by energizing the electric motor connected to the jackscrew devices 48–54. Thus, when the jackscrew devices 48–54 are simultaneously activated to raise each of the screw shafts 56, the outer ends of the subframe members 14 and 16 are raised about pivot shaft 38 and the strapping machine 10 is thereby adjusted in position and placed in a "V" configuration for accepting and applying straps to a V-shaped package. It will be understood that the angle at which the subframe members 14 and 16 will be located relative to a horizontal plane passing through the center of pivot shaft 38, will depend upon the angle between the legs of the V-shaped package.

Various changes and modifications can be made in this construction without departing from the spirit of the invention. Such changes and modifications are contemplated by the inventors, and they do not wish to be limited except by the scope of the appended claims.

The embodiments of the invention for which an exclusive property or privilege is claimed are defined as follows:

1. A strapping machine for applying a pair of straps about a package, said strapping machine comprising first and second strap-feeder and tensioning devices each of which includes a strap-feed guide member and a strap-return guide member aligned along a first axis; first and second chutes located adjacent said first and second strap-feeder and tensioning devices respectively, each of said first and second chutes having a strap-entry portion and a strap-exit portion; means operatively connected to each of said chutes for moving said chutes between a first position wherein said strap-entry portion and said strap-exit portion are axially aligned with said strap-feed guide member and said strap-return guide member respectively of the associated strap-feeder and tensioning device for applying one strap to said package, and a second position wherein said strap-entry portion and said strap-exit portion are spaced vertically from said strap-feed guide member and said strap-return guide member of said associated strap-feeder and tensioning device for receiving said package; and means supporting each of said first and second strapping feeder and tensioning devices and its associated chute for adjustable and coordinated movement along a second axis which is perpendicular to said first axis so as to vary the distance between said first and second strap-feeder and tensioning devices and thereby vary the distance between said pair of straps.

2. A strapping machine for applying a pair of straps about a package, said strapping machine comprising first and second strap-feeder and tensioning devices each of which includes a strap-feed guide member and a strap-return guide member aligned along a first horizontal axis; a conveyor connected to each of said first and second strap-feeder and tensioning devices for feeding said package into said strapping machine; first and second C-shaped chutes located adjacent said first and second strap-feeder and tensioning devices respectively, each of said first and second C-shaped chutes having a strap-entry portion and a strap-exit portion interconnected by a generally circular track; means operatively connected to each of said chutes for moving said chutes between a first position wherein said strap-entry portion and said strap-exit portion are axially aligned with said strap-feed guide member and said strap-return guide member respectively of the associated strap-feeder and tensioning device for applying one strap to said package, and a second position wherein said strap-entry portion and said strap-exit portion are spaced vertically from said strap-feed guide member and said strap-return guide member of said associated strap-feeder and tensioning device for receiving said package fed by said conveyor; and means supporting each of said first and second strap-feeder and tensioning devices and its associated chute for adjustable and synchronous movement along a second horizontal axis which is perpendicular to said first horizontal axis so as to vary the distance between said first and second strap-feeder and tensioning device and thereby vary the distance between said pair of straps.

3. A strapping machine for applying a pair of straps about a V-shaped package, said strapping machine comprising first and second strap-feeder and tensioning devices each of which includes a strap-feed guide member and a strap-return guide member aligned along a first horizontal axis; first and second chutes located adjacent said first and second strap-feeder and tensioning devices respectively, each of said first and second chutes having a strap-entry portion and a strap-exit portion interconnected by a generally circular track; means operatively connected to each of said chutes for moving said chutes between a first position wherein said strap-entry portion and said strap-exit portion are axially aligned with said strap-feed guide member and said strap-return guide member respectively of the associated strap-feeder and tensioning device for applying one strap to said package, and a second position wherein said strap-entry portion and said strap-exit portion are spaced vertically from said strap-feed guide member and said strap-return guide member of said associated strap-feeder and tensioning device for receiving said package; and first and second frame means supporting said first and second strap-feeder and tensioning devices and the associated chutes for adjustable movement about a second horizontal axis which is parallel to said first horizontal axis so that each of said first and second strap-feeder and tensioning devices is angularly movable about said second horizontal axis for applying said pair of straps to said V-shaped package.

4. A strapping machine for applying a pair of straps about a package, said strapping machine comprising first and second strap-feeder and tensioning devices each of which includes a strap-feed guide member and a strap-return guide member aligned along a first horizontal axis; a conveyor connected to each of said first and second strap-feeder and tensioning devices for feeding said package into said strapping machine; first and second C-shaped chutes located adjacent said first and second strap-feeder and tensioning devices respectively, each of said first and second C-shaped chutes hving a strap-entry portion and a strap-exit portion interconnected by a generally circular track; means operatively connected to each of said chutes for moving said chutes between a first position wherein said strap-entry portion and said strap-exit portion are axially aligned with said strap-feed guide member and said strap-return guide member respectively of the associated strap-feeder and tensioning device for applying one strap to said package, and a second position wherein said strap-entry portion and said strap-exit portion are spaced vertically from said strap-feed guide member and said strap-return guide member of said associated strap-feeder and tensioning device for receiving said package fed by said conveyor; and means supporting each of said first and second strap-feeder and tensioning devices and its associated chute for adjustable and synchronous movement along a second horizontal axis which is perpendicular to said first horizontal axis so as to vary the distance between said first and second strap-feeder and tensioning devices and thereby vary the distance between said pair of straps; said means supporting each of said first and second strap-feeder and tensioning devices and its associated chute including guide rod means and a screw-nut assembly connected to each of said first and second strap-feeder and tensioning devices and to each of said first and second C-shaped chutes for providing said adjustable and synchronous movement along said second horizontal axis.

5. A strapping machine for applying a pair of straps about a V-shaped package, said strapping machine comprising first and second strap-feeder and tensioning devices each of which includes a strap-feed guide member and a strap-return guide member aligned along a first axis; first and second chutes located adjacent said first and second strap-feeder and tensioning devices respectively, each of said first and second chutes having a strap-entry portion and a strap-exit portion interconnected by a generally circular track; means operatively connected to each of said chutes for moving said chutes between a first position wherein said strap-entry portion and said strap-exit portion are axially aligned with said strap-feed guide member and said strap-return guide member respectively of the associated strap-feeder and tensioning device for applying one strap to said package, and a second position wherein said strap-entry portion and said strap-exit portion are spaced vertically from said strap-feed guide member and said strap-return guide member of said associated strap-feeder and tensioning device for receiving said package; a first frame supporting said first strap-feeder and tensioning device and said first chute for adjustable and synchronous movement along a second axis which is perpendicular to said first axis; a second frame supporting said second strap-feeder and tensioning device and said second chute for adjustable and synchronous movement along a third axis which is perpendicular to said first axis; means interconnecting said first frame and said second frame for pivotal movement about a fourth axis which is parallel to said first axis; and power-operated means connected to said first and second frames for moving said frames about said fourth axis whereby each of said first and second strap-feeder and tensioning device and each of said first and second chutes is angularly adjusted about said fourth axis for applying said pair of straps to said V-shaped package.

* * * * *